US006190266B1

(12) United States Patent
Pamias

(10) Patent No.: US 6,190,266 B1
(45) Date of Patent: Feb. 20, 2001

(54) GOLF PUTTER

(76) Inventor: Francisco Pamias, 140 Bath Ave., Staten Island, NY (US) 10305

( * ) Notice: Under 35 U.S.C. 154(b), the term of this patent shall be extended for 0 days.

(21) Appl. No.: 09/240,349

(22) Filed: Jan. 29, 1999

Related U.S. Application Data

(60) Provisional application No. 60/074,664, filed on Feb. 13, 1998.

(51) Int. Cl.[7] ..... A63B 53/02; A63B 53/14

(52) U.S. Cl. ..... 473/294; 473/313; 473/314

(58) Field of Search ..... 473/296, 313, 473/314, 340, 341, 204

(56) References Cited

U.S. PATENT DOCUMENTS

| | | | |
|---|---|---|---|
| 2,962,288 | | 11/1960 | Lowden . |
| 3,663,019 | | 5/1972 | Palotsee . |
| 3,874,668 | | 4/1975 | Flege . |
| 4,227,694 | | 10/1980 | Drake . |
| 4,795,153 | | 1/1989 | Thomas . |
| 4,819,944 | | 4/1989 | Doane . |
| 5,125,130 | * | 6/1992 | Stanish ..... 473/204 |
| 5,125,657 | | 6/1992 | Beil . |
| 5,127,650 | | 7/1992 | Schneller . |
| 5,328,185 | | 7/1994 | Finnigan et al. . |
| 5,401,022 | | 3/1995 | McCready . |
| 5,558,586 | | 9/1996 | Izett et al. . |
| 5,595,385 | | 1/1997 | Jablonski . |
| 5,616,087 | * | 4/1997 | Bothwell ..... 473/316 |
| 6,015,355 | * | 1/2000 | Angel ..... 473/314 |

* cited by examiner

*Primary Examiner*—Jeanette Chapman
*Assistant Examiner*—Stephen L. Blau
(74) *Attorney, Agent, or Firm*—Auslander & Thomas

(57) ABSTRACT

An ergonometric golf putter having a zigzag shaft with an intermediate handle, shaft arms and a handgrip. The configuration better enables the golfer to sight the ball and effect a putt. The same putter is usually adaptable for a right or left handed user.

10 Claims, 2 Drawing Sheets

FIG. 5
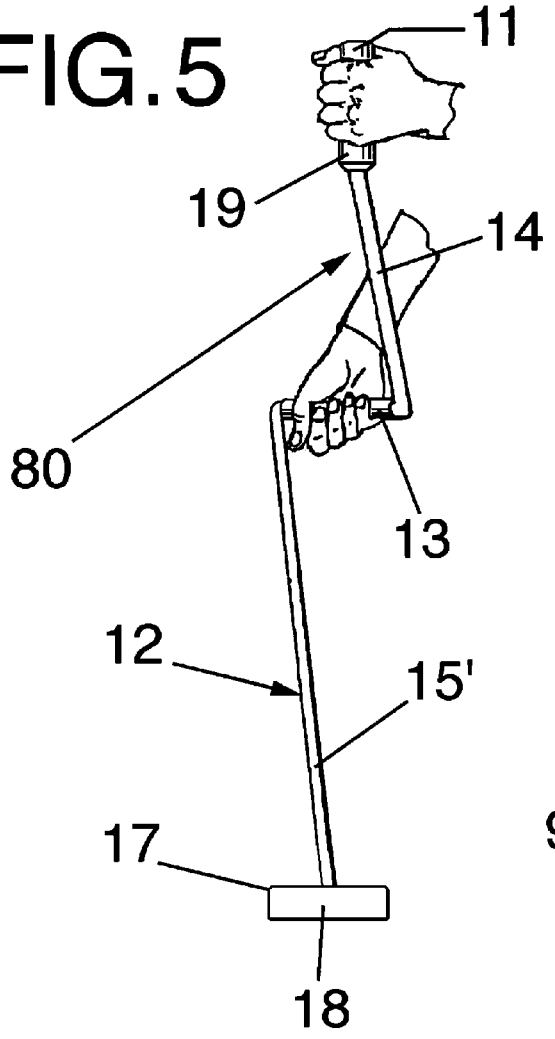
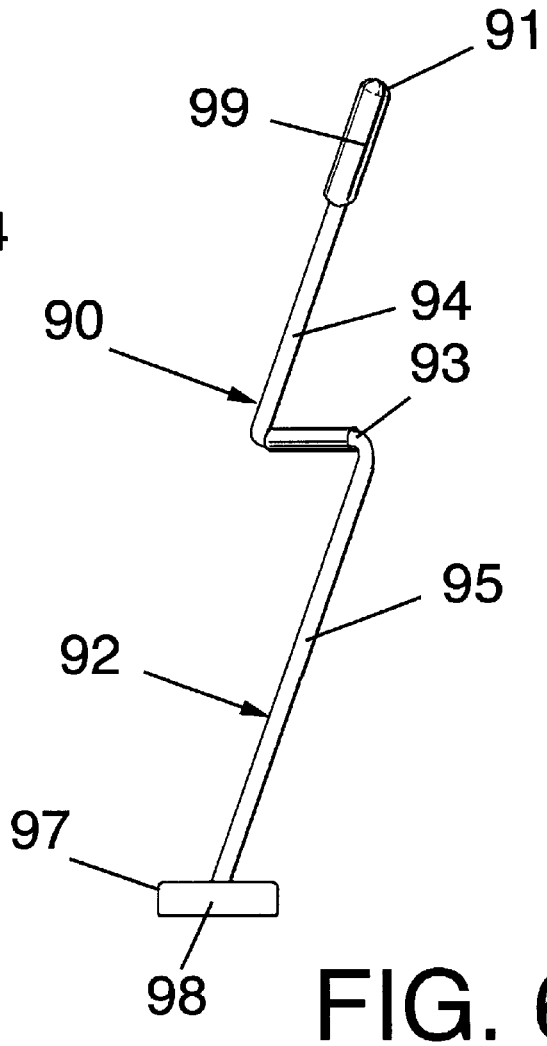
FIG. 6
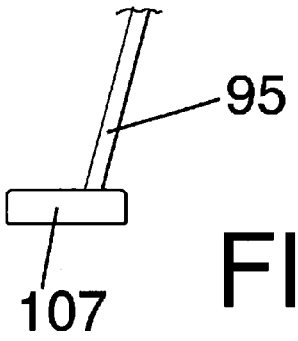
FIG. 7

GOLF PUTTER

The present invention is a continuation of Provisional Application Ser. No. 60/074,664 filed Feb. 13, 1998.

The present invention is an ergonometric golf putter.

BACKGROUND OF THE INVENTION

The golf putter performs a function different from the other clubs in a set. The other clubs are designed for moving the ball across assorted terrains, distances and hazards and are generally designed for the free flowing swing of the club head selected for the particular situation for each hole. There is a tee off, usually with a driver, and the clubs, with selected heads, to move the ball onto the green. The green presents a different golfing pattern, a substantially uniform, usually flat pattern, with short, clipped grass.

The putter, with its particular head, does not have to move the golf ball great distances, nor is the putter used for heavy swinging. The putter head is usually without an angle, because the ball does not usually have to be lifted over uneven terrain, such as along the fairway or the rough. There are many different types of putters with special shafts and putting heads and second hand grips for the control of the careful swing necessary to putt.

The prior art has included offset shafts, elongagted shafts, shafts with intermediate handles along their length, shafts with end handles and multiple shafts.

The present invention is an improved putter which provides an egonometric gripping system. The wrist of the hand on the central handle is substantially unbent for the gripping of the second handle of the present invention. The putter is substantially the same length as prior art putters and facilitates an improved stroke.

DESCRIPTION OF THE RELATED ART

U.S. Pat. No. 4,795,153 discloses a golf putter with an offset articulated shaft with a single grip for two hands.

U.S. Pat. No. 5,328,185 discloses a golf putter with an extended length shaft to be held against the front of the golfer's body. There is an upper hand grip and an intermediate, looping, substantially horizontal hand grip, extending on a plane substantially perpendicular from the back end of the putter head. The substantially horizontal hand grip requires the wrist to be twisted to face the body. The palm of the hand gripping the horizontal handle faces the body.

U.S. Pat. No. 4,227,694 discloses a zigzag putter shaft with a grip for two hands at its end. The shaft is intermediate of the putter face, with the upper portion and the lower portion, aligned with the putter. A portion of the shaft extends outwards from the center of the putter.

U.S. Pat. No. 5,127,650 discloses a putter with a linear shaft at one end of the putter head and a right angulated horizontal handle at the top of the shaft, with a hand grip for the other hand, along the length of the shaft.

U.S. Pat. No. 3,874,668 discloses a golf putter with a shaft in the center of an oblong putter head. The golf club is a one hand putter, with an arm rest and an off horizontal arm support.

U.S. Pat. No. 4,819,944 discloses an exercise golf club with an offset parallel second handle, which might also include use for a putter.

U.S. Pat. No. 5,595,385 discloses a golf putter with a straight and/or angulated shaft at an obtuse angle from one end of the putter head, with a second hand grip at the top, extending substantially on a parallel plane to the plane of the putter head. The putter includes other assorted handle combinations including other parallel and adjustable upper handles.

U.S. Pat. No. 3,663,019 discloses a golf putter with a putter shaft at an obtuse angle from one end of the putter and an adjustable articulable upper handle extending from the top portion of the shaft.

U.S. Pat. No. 5,558,586 discloses a golf putter with a V shaped double shaft for putters and/or other golf clubs.

U.S. Pat. No. 5,125,657 discloses a golf putter with an upper end flexible pivot cord and finger grip.

U.S. Pat. No. 5,401,022 discloses a golf putter with a substantially T shaped double hand grip.

U.S. Pat. No. 2,962,288 discloses a conventional golf putter with an intermediate hand grip along the length of the handle of the shaft, extending on both sides of the hand grip of the shaft.

It is respectfully requested that this citation of art consist of record about the within application.

SUMMARY OF THE INVENTION

The present invention is an ergonometric putter with a zigzag shaft. The distance from the upper handle to the putter head is substantially the same as a conventional putter. At one end of the shaft is a conventional longitudinal hand grip. A zigzag part of the shaft forms an intermediate handle for a second hand grip. The second handle is on a plane aligned with the position of the putter head. There is a linear relationship between the upper handle of the shaft and the putter head.

Although such novel feature or features believed to be characteristic of the invention are pointed out in the claims, the invention and the manner in which it may be carried out may be further understood by reference to the description following and the accompanying drawings.

BRIEF DESCRIPTION OF THE DRAWINGS

Referring now to the figures in greater detail, where like reference numbers denote like parts in the various figures.

FIG. 5 is a front elevation embodiment similar to FIG. 1 showing the portion of a golfer's hands engaged in use.

FIG. 6 is another embodiment of the putter of the present invention showing the putter with the upper and lower arms of the shaft parallel with each other.

FIG. 7 is a cut away front elevation detail of another embodiment of the golf putter of FIG. 6 with shaft engaged at one end of the putter head.

DESCRIPTION OF THE PREFERRED EMBODIMENTS

Figure 1:
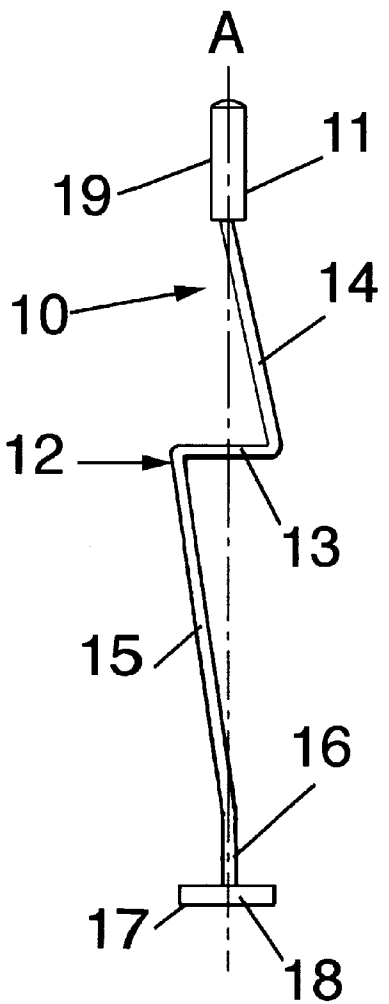
FIG. 1 is front elevation of a putter of the present invention with the shaft extending from the center of the putter head and with an intermediate handle parallel to the putter head.

The putter 10, as shown in FIG. 1, has an upper hand grip 11 along a shaft 12. The shaft 12 is articulated to have a handle 13. The handle 13 is between an upper arm 14 of the shaft 12 and a lower arm 15 of the shaft 12. A shaft end 16 engages the putter head 17. The putter head 17 has a striking face 18.

The upper hand grip 11 and shaft end 16 are along a center line A, passing through the putter head 17. The upper hand grip 11 may have a conventional gripping surface 19.

Figure 2:
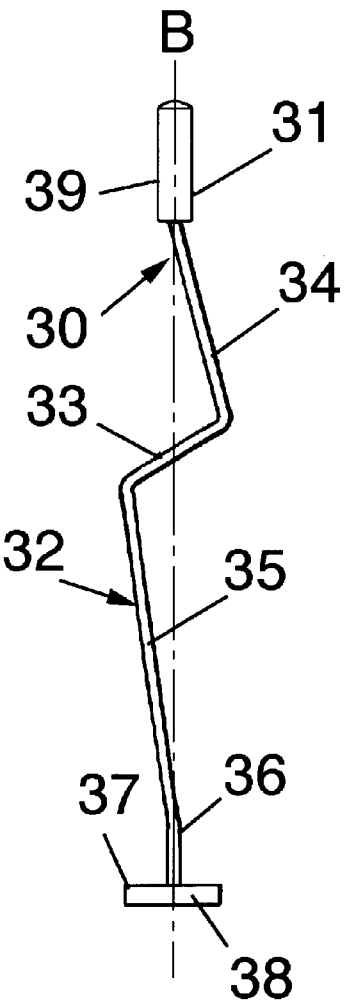
FIG. 2 is a front elevation of another embodiment of the present invention similar to FIG. 1 with an intermediate handle slightly off, being horizontal with regard to the putter head.

The putter 30, as shown in FIG. 2, has an upper hand grip 31 along a shaft 32. The shaft 32 is articulated to have a handle 33. The handle 33 is between an upper arm 34 of the shaft 32 and a lower arm 35 of the shaft 32. A shaft end 36 engages the putter head 37. The putter head 37 has a striking face 38.

As shown in FIG. 1, the putter 10 has a handle 13 substantially parallel to the plane of, and aligned with, the putter head 17. The angulation of the upper arm 14 and the angulation of the lower arm 15 define the width of the handle 13. The putter 10 can be used by a either a right handed or left handed golfer. The putter head 17 may also have a second striking face (not shown) in the Figures, on its opposite side. The center line A extends between the upper hand grip 11 and shaft end 16 where the shaft 12 is attached to the putter head 17.

As shown in FIG. 2, the putter 30 has a handle 33 on a plane with the direction of the putter head 37, but off right angulation. The angulation of the upper arm 34 and the angulation of the lower arm 35 define the length of the handle 33. The putter 30 can be used by either a right handed or left handed golfer. The putter head 37 may also have a second striking face (not shown) in FIGS. 1–4, on its opposite side. The center line B extends between the upper hand grip 31 and shaft end 36 where the shaft 32 is attached to the putter head 37. The handle 33 serves the same function as the handles 13, 53 and 73, as shown in FIGS. 1, 3 and 4, without changing the center line B of the putter 30.

The upper arm 34 and lower arm 35 of the putter 30 are both shorter than the respective upper and lower arms 14, 15 of the putter 10. Thus, the intermediate handle 33 which is integral to the shaft 32 is aligned but not parallel to the putter head 37. The putter 30 can be used by either a right handed or left handed golfer.

The upper hand grip 31 and shaft end 36 are all along a center line B, passing through the putter head 37. The upper hand grip 31 may have a conventional gripping surface 39.

Figure 3:
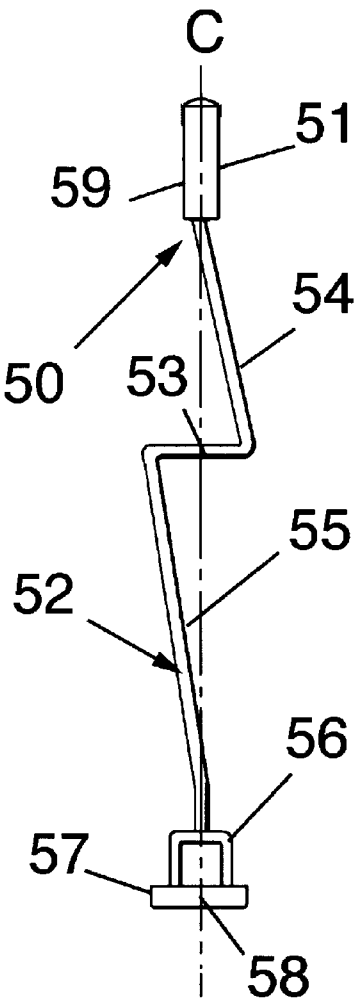
FIG. 3 is a front elevation of the putter of FIG. 1 with a fork on the shaft attached to the putter head.
Figure 4:
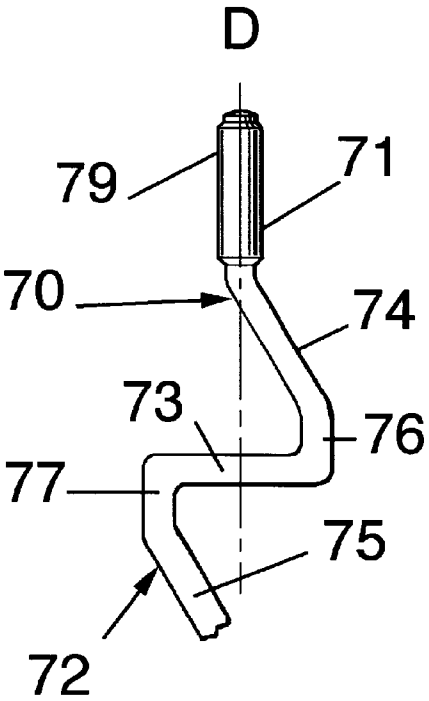
FIG. 4 is a cut away front elevation detail of another embodiment of the golf putter of FIG. 1 with additional shaft articulations.

The putter 50, as shown in FIG. 3, has an upper hand grip 51 along a shaft 52. The shaft 52 is articulated to have a handle 53. The handle 53 is between an upper arm 54 of the shaft 52 and a lower arm 55 of the shaft 52. A U shaped shaft end 56 engages the putter head 57. The putter head 57 has a striking face 58.

The upper hand grip 51 and U shaped shaft end 56 are all along a center line C, passing through the putter head 57. The upper hand grip 51 may have a conventional gripping surface 59.

The shaft 52 of the putter 50 has a shaft end 56 is U shaped, straddling the putter head 57 to which it is connected at two points. The putter 50 can be used by either a right handed or left handed golfer.

The detail of the putter 70, as shown in FIG. 4, has an upper hand grip 71 along a shaft 72. The shaft 72 is articulated to have a handle 73. The handle 73 is between an upper arm 74 of the shaft 72 has a lower arm 75 of the shaft 72. The shaft 72 connects to a putter head (not shown).

The upper hand grip 71 and the shaft 72 are along a center line D, passing through the putter head (not shown). The upper hand grip 71 may have a conventional gripping surface 79.

The upper arm 74 includes an articulation 76 that is parallel to the center line D and which is integral to the shaft 72 between the upper arm 74 and the handle 73. There is also an articulation 77, that is parallel to the center line D, which is integral to the shaft 72 between the lower arm 75 and the handle 73.

The upper arm 74 and lower arm 75 of the putter 70 are both short. These arms 74 and 75 include respective integral short articulations 76 and 77 which are parallel to the center line D. Thus, the intermediate handle 73 which is integral to the shaft 72, is parallel to the putter head (not shown). The putter 70 can be used by either a right handed or left handed golfer.

In FIG. 4, the articulations 76, 77 extend parallel to the center line D along the length of the shaft 72 one inch from either end of the handle 73 from its ends.

The upper hand grips 11, 31, 51, 71 and 91, as shown in FIGS. 1, 4, 5 and 6 are preferably about four and a half inches long.

In the putter 80, as shown in FIG. 5, is substantially the same as the putter 10 of FIG. 1, except that shaft $\mathbf{15}^1$ angulates directly into the center of the putter head 17.

As shown in FIG. 6, the putter 90 has a handle 93 substantially parallel to the plane of, and aligned with, the putter head 97. The putter 90 can be used by a either a right handed or left handed golfer. The putter head 97 has a striking face 98. The upper hand grip 91 may have a gripping surface 99.

The putter head 107 as shown in FIG. 7 is a modification of the putter 90 of FIG. 6. The shaft 95 angulates directly into one end of the putter head 107.

In all of the embodiments of the present invention the length of the putters 10, 30, 50, 70, 80 and 90 from the top of the upper hand grip 11, 31, 31, 71 and 91 to the bottom of the putter head 17, 37, 57, the (not shown) putter head in the embodiment of FIG. 4, and the putter head 97, preferably vary from a length of approximately thirty inches to approximately fifty six inches. The shafts 12, 32, 52, 72 and 92 may be used with other selected putter heads.

As can be seen in FIGS. 1–4, each of the disclosed embodiments of the present invention include upper hand grips 19, 39, 59 and 79, shafts 12, 32, 52, and 72 and handles 13, 33, 53 and 73. As shown in FIGS. 1 and 2, the shaft ends 16 and 36 connect to the center of the respective putter heads, 17 and 37 aligned with the respective center lines A and B.

As shown in FIG. 3, the U shaped shaft end 56 connects to 1. two sides of the putter head 57 aligned with the center line C. 1—The shaft 72 of the putter 70, as shown in FIG. 4, is also aligned with the center line D in the same manner. The lower arm 75 is adapted to terminate with a single shaft end (not shown), such as shown in FIGS. 1 and 2, or a U shaped shaft (not shown), such as shown in FIG. 3, aligned with the center line C.

The putter 70, as shown in FIG. 4, has a handle 73 that is perpendicular to the center line D, just as the handles 13 and 53 are perpendicular to their respective center lines, A and C. The shaft 72 is distinguished from the other embodiments of the present invention by the articulations 76 and 77 integral in the shaft 72 and parallel to the center line D. Typically, the handle 13, 33, 53, 73 and 93 is about twelve inches from the top of the upper hand grip 11, 31, 51, 71 and 91, shaft 12, 32, 52 72 and 92 is about three eighths of an inch in diameter.

In use, the golfer engages one hand conventionally on the upper hand grip 11, 31, 51 71 and 91 and the other hand on the handle 13, 33, 53 73 and 93. There is a direct line of sight along the center lines A, B, C, and D, of the respective putters 10, 30, 50, and 70. The golfer's other hand grasps the respective handles 13, 33, 53 73 and 93 with the thumb pointing outward with the hand substantially on a plane perpendicular to the body, but not necessarily parallel to the ground.

The configuration of the putter 10, 30, 50, 70, 80 and 90 minimizes strain or stress on the golfer's hands and wrists while the hand on the handle 13, 33, 53 and 73 is effective to control the stroke without obscuring the centerline A, B, C or D of the putter 10, 30, 50 and 70 or the putter heads 17,37, 57, 97 or 107.

The putters 10, 30, 50, 70, 80 and 90, as shown in FIGS. 1–6, are useable as shown in the FIGS. 1–6, or turned 180°. Where the putter head 17, 37, 57, 97 has a strike face 18, 38, 58, 98 on either side, the putters 10, 30, 50, 70, 80 and 90 may be used by right handed golfers or left handed golfers. As a matter of taste, the putters 10, 30, 50, 70, 80 and 90 of the present invention may have an off center putter head 107, as shown in FIG. 7.

The terms and expressions which are employed are also used as terms of description; it is recognized, though, that various modifications are possible.

It is also understood the following claims are intended to cover all of the generic and specific features of the invention herein described, and all statements of the scope of the invention which, as a matter of language, might fall therebetween.

What is claimed is:

1. A golf putter, said putter including a shaft; and a putter head, said shaft having a zigzag configuration and including at least; a hand grip; an upper arm; a handle; and a lower arm, said upper arm including an outer end; said hand grip at said outer end of said upper arm, said handle between said upper arm and said lower arm, said upper arm and said lower arm extending on a plane substantially parallel to each other, said handle aligned extending parallel over said putter head, and means at said lower arm joining said shaft and said putter head.

2. The invention of claim 1 with said hand grip is aligned extending vertically and centered over said putter head.

3. The invention of claim 1 wherein said lower arm directly engages said putter head.

4. The invention of claim 1 including-a shaft end, said shaft end at said lower arm, and said shaft end directly engaging said putter head.

5. The invention of claim 1 including a U shaped shaft end at said lower arm, said U shaped shaft including two ends, and said U shaped shaft ends directly engaging said putter head.

6. The invention of claim 1 wherein said lower arm engages said putter head at its center.

7. The invention of claim 1 wherein said putter head has a first end and a second end, and said lower arm engages said putter head at one such end.

8. The invention of claim 1 wherein said upper and lower arms including a pair of short integral articulated portions, said articulated portion extending parallel to each other.

9. The invention of claim 1 wherein said hand grip and said upper arm extend in linear alignment.

10. The invention of claim 1 wherein said hand grip extends in vertical alignment with the center of said putter head.

* * * * *